US007270171B2

(12) United States Patent
Campomanes et al.

(10) Patent No.: US 7,270,171 B2
(45) Date of Patent: Sep. 18, 2007

(54) EVAPORATIVE FOAM RISERS WITH EXOTHERMIC TOPPING

(76) Inventors: Edgardo Campomanes, P.O. Box 544, Cando, ND (US) 58324; Patrick Campomanes, 1315 Riverchase Dr., Coppell, TX (US) 75019

( * ) Notice: Subject to any disclaimer, the term of this patent is extended or adjusted under 35 U.S.C. 154(b) by 85 days.

(21) Appl. No.: 10/855,550

(22) Filed: May 26, 2004

(65) Prior Publication Data

US 2004/0238153 A1 Dec. 2, 2004

Related U.S. Application Data

(60) Provisional application No. 60/473,779, filed on May 27, 2003.

(51) Int. Cl.
*B22C 9/02* (2006.01)

(52) U.S. Cl. ..... 164/359; 164/244

(58) Field of Classification Search ..... 164/359, 164/360, 244, 246
See application file for complete search history.

(56) References Cited

U.S. PATENT DOCUMENTS

| | | | | |
|---|---|---|---|---|
| 3,273,211 | A * | 9/1966 | Miraldi | 164/24 |
| 3,452,806 | A * | 7/1969 | Adalbert | 164/246 |
| 4,140,838 | A * | 2/1979 | Reiland | 428/542.8 |
| 4,141,406 | A * | 2/1979 | Wukovich | 164/359 |
| 4,188,010 | A * | 2/1980 | Reiland | 249/197 |
| 4,423,762 | A * | 1/1984 | Trinkl et al. | 164/37 |
| 4,467,858 | A * | 8/1984 | Trinkl et al. | 164/360 |
| 4,719,958 | A * | 1/1988 | Schopp et al. | 164/29 |
| 5,299,625 | A * | 4/1994 | Miki | 164/359 |
| 6,096,253 | A * | 8/2000 | Miki et al. | 264/219 |
| 6,343,642 | B1 * | 2/2002 | Miki | 164/359 |
| 6,640,874 | B2 * | 11/2003 | Vorndran et al. | 164/15 |

* cited by examiner

*Primary Examiner*—Jonathan Johnson

(57) ABSTRACT

This invention consists of the use of an evaporative foam riser made with expanded polystyrene and with a cavity on top that contains an exothermic mixture. The reaction of the exothermic material, which is set off when it comes in contact with the metal, prolongs the solidification time of the riser thus rendering it more effective.

12 Claims, 5 Drawing Sheets

EVAPORATIVE FOAM RISERS WITH EXOTHERMIC TOPPING

CROSS REFERENCE TO RELATED APPLICATIONS

This application is entitled to the benefit of Provisional Patent Application No. 60/473,779 filed on May 27, 2003 by Edgardo Campomanes titled "Evaporative Foam Risers with Exothermic Topping"

BACKGROUND

1. Field of Invention

This invention relates to the use of an evaporative foam risers made of expanded polystyrene with a cavity on the upper surface that is filled with exothermic topping which is used to increase the feeding efficiency of a conventional blind riser.

2. Description of Prior Art

Risers are devices that supplies metal to the casting while in the process of solidifying. Without an adequately sized riser, the casting will contain voids (shrink holes) that develop when the casting solidifies and its volume contracts. Risers are therefore essential in obtaining a sound casting.

Risers can be encased in sand or in an insulating or exothermic material. The use of insulating and exothermic sleeves is a common practice in making casting. Normally, the most common type of riser sleeve is manufactured from fiber based refractory mineral. The pores of the fibers are impregnated with exothermic material while under vacuum. These materials extend the solidification time of the riser. The longer the extension of the solidification time, the smaller is the size of the required riser, thus increasing the yield. The use of these sleeves, however, has some disadvantages:

They are considerably more expensive than the equivalent sand riser.

Because of their weight, they tend to fall off while transporting the mold thus causing scrap.

The refractory fibers do not burn off during the casting process thus it contaminates the sand system and may cause casting defects.

The use of sand (encased) riser is the most common application in the manufacture of castings. They usually are part of the pattern equipment. They are inexpensive to use but because they lack a source of additional heat, they have shorter solidification time than the exothermic sleeve riser and thus requires more metal.

SUMMARY

In accordance with the present invention a riser comprises the use of an evaporative foam riser made with expanded polystyrene and with a cavity on top that contains an exothermic mixture. The riser is placed on top of the pattern while molding and left inside the mold. The exothermic mixture may be one of the many commercially available, which is usually a combination of particles of aluminum, iron oxide and inert insulating material. The reaction of the exothermic material, which is set off when it comes in contact with the metal, prolongs the solidification time of the riser thus rendering it more effective.

Objects And Advantages

Accordingly, several objects and advantages of the present inventions are:

To provide an inexpensive means of providing a riser with an exothermic heat source.

To provide a means of extending the solidification time of the riser.

To provide a means of preventing the exothermic material to fall into the casting chamber before the metal enters the riser body.

To provide a means of eliminating fibrous material in the manufacture of exothermic risers.

DRAWINGS AND FIGURES

REFERENCE NUMERALS IN DRAWINGS

26—foam riser body
30—exothermic mixture
34—Heat Shield
38—Breaker Core
42—Chamber
46—Cover
50—Molded Exothermic insert

DESCRIPTION

Figure 1:
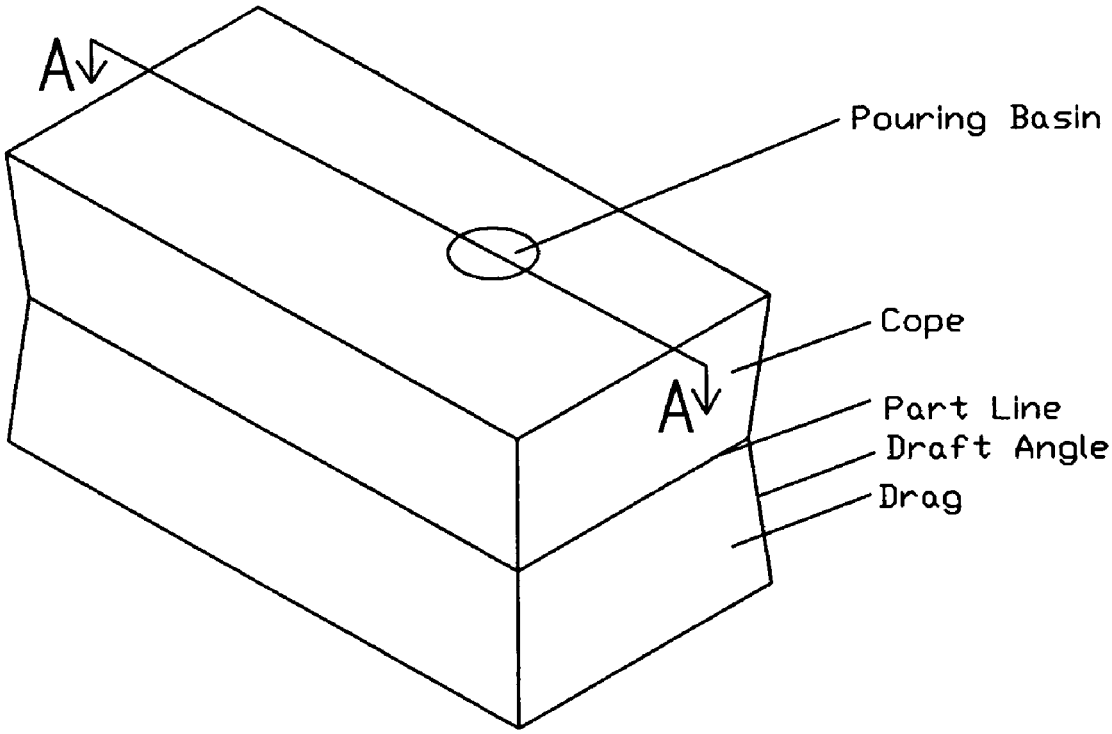
FIG. 1 is a mold showing where cross sectional views are taken.
Figure 2:
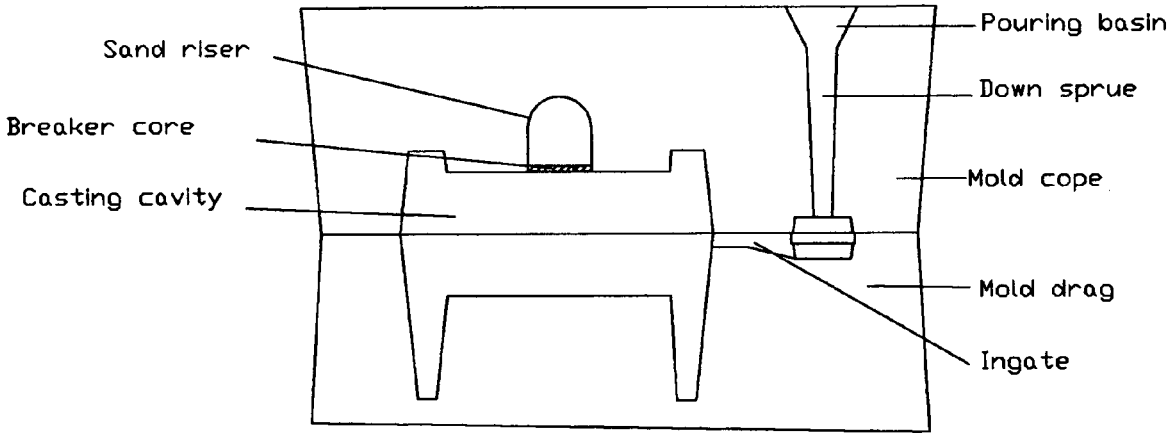
FIG. 2 is a cross sectional view of a normal mold showing the essential parts of the gating system including risers

FIG. 2 shows the prior art when using sand riser.

Figure 3:
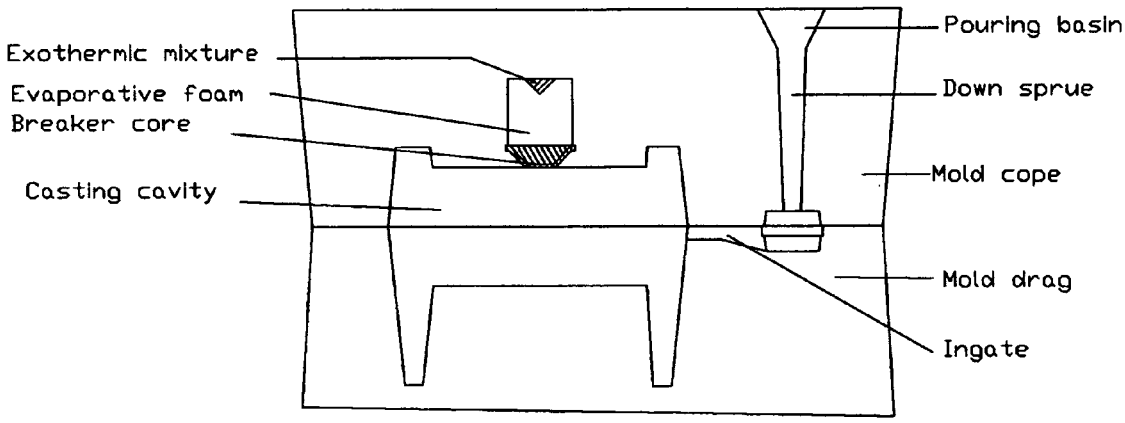
FIG. 3 is the same cross sectional view of the same mold but using evaporative foam risers as preferred embodiment.

FIG. 3 shows the present invention used as a riser.

Preferred Embodiment

Figure 4:
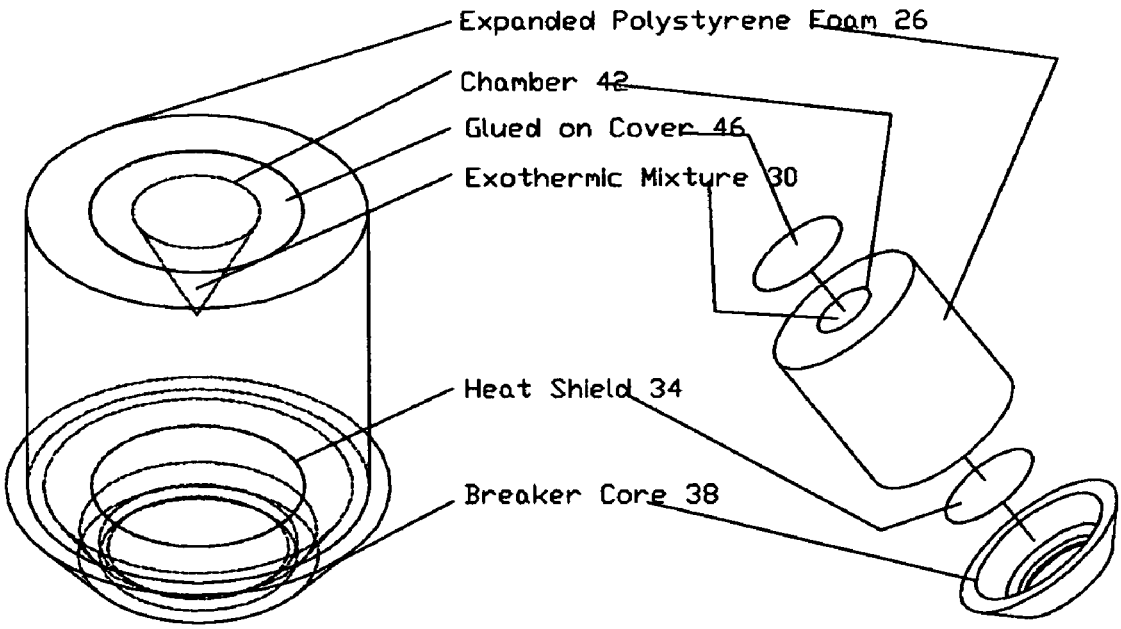
FIG. 4 shows isometric view of the evaporative foam riser.

The preferred embodiment is shown in FIG. 4

The Riser body consists of expanded polystyrene foam (26.) A thin layer of metallic foil usually made up of aluminum (34) is glued to the bottom of the riser body. This acts as a heat shield to prevent the premature vaporization of the foam. The foam riser body (26) is glued to a breaker core. A hollowed out chamber (42) is located on top of the foam riser body. Sufficient exothermic mixture fills the chamber in order to extend the solidification time of the riser. A cover (46) is glued to the top foam riser body (26) to prevent the exothermic mixture from spilling out.

Alternative Embodiment

Figure 5:
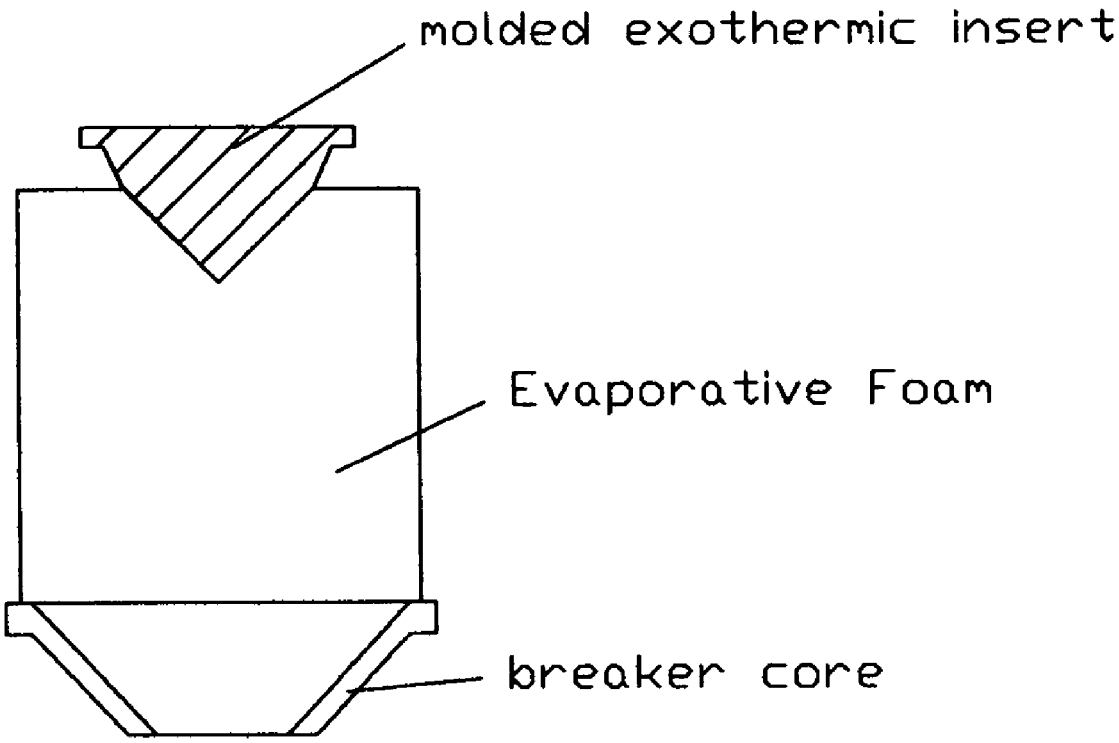
FIG. 5 shows alternative embodiment where a heat shield is not used and exothermic reaction is supplied not by loose powder but by a molded self-anchoring structure made up of exothermic mixture.

Alternative embodiment is shown in FIG. 5.

There are various possibilities to attain the same effect of the preferred embodiment. In FIG. 5, heat shield 34 is eliminated because the exothermic mixture is molded into a shape that would not be able to fall through the opening of the breaker core. In case of premature vaporization, the exothermic mixture will not spill into the casting chamber. This solid exothermic material can also be anchored to the roof of the riser and stay there until it is ignited by the contact of molten metal.

Advantages

From the description above, a number of advantages of this invention become evident:

1. It provides a more effective feeding than a conventional riser because of the presence of exothermic material on top of the riser.
2. The bulk of the riser is made up of expanded polystyrene foam. Thus, it is lighter and cheaper to produce than conventional exothermic or insulating sleeves.
3. Unlike exothermic sleeves, it does not use fibers that could contaminate the sand system.

Operation

The foam riser is glued into a breaker core. The riser can either be molded-in or inserted after molding. If the riser is molded-in, a tapered breaker core can be used.

The hole of the breaker core is set on a locator. The purpose of this locator is to define the position of the riser and to temporarily prevent the riser from moving during molding. Molding proceeds while the operator holds the riser. When the molding is done, the pattern is withdrawn towards the parting line. The riser is left inside the mold. The mold is closed and is ready to pour.

When the metal enters the riser, it melts the heat shield then vaporizes the foam. The metal ignites the exothermic mixture when it reaches the top of the riser. The exothermic reaction generates heat to keep riser hot.

The riser can also be inserted into a cavity formed by the pattern after molding. The foam riser dimension is slightly less than the riser cavity. The foam compresses when inserted and is held in place by friction against the sand walls. A flat bottom breaker has to be used when the foam riser is inserted.

CONCLUSION

Accordingly, the reader will see that the evaporative foam riser as described in this invention can be used effectively while considerable benefits can also be derived from its usage. The evaporative foam riser consists of an assembly of a breaker core, a heat shield, a foam body with a cavity that is filled up with exothermic material. Metal enters from the breaker core, vaporizes the foam and ignites the exothermic material when it reaches the top of the riser. The exothermic reaction provides the heat to delay the solidification of the riser.

Several benefits come with this process:

It provides a simple and inexpensive means of manufacturing exothermic riser.

It minimizes the problem of riser falling off to the main cavity after assembly.

It does not utilize fibrous material that will contaminate the sand system.

The invention claimed is:

1. A combination of a foundry mold and a riser, the riser comprising a body of an evaporative foam material with a cavity on top of the body and an exothermic mixture in the cavity, wherein the evaporative foam material comprises polystyrene foam and wherein the exothermic mixture comprises aluminum particles and iron oxide particles.

2. The combination of claim 1, wherein the riser further comprises a cover attached to the top of the body and covering the exothermic mixture.

3. The combination of claim 1, wherein the exothermic mixture comprises a molded structure.

4. A combination of a foundry mold and a riser, the riser comprising a body of an evaporative foam material with a cavity on top of the body and an exothermic mixture in the cavity and wherein the riser further comprises a heat shield attached to the bottom of the body to prevent premature evaporation of the evaporative foam material.

5. The combination of claim 4, wherein the riser further comprises a breaker core attached to the bottom of the body.

6. A combination of a foundry mold and a riser, the riser comprising a body of an evaporative foam material with a cavity on top of the body and an exothermic mixture in the cavity and wherein the riser further comprises a breaker core attached to the bottom of the body.

7. A riser comprising a body of evaporative foam material with a cavity on top of the body and an exothermic mixture in the cavity and wherein the exothermic mixture comprises aluminum particles and iron oxide particles.

8. The riser of claim 7, further comprising a cover attached to the top of the body and covering the exothermic mixture.

9. The riser of claim 7, wherein the exothermic mixture comprises a molded structure.

10. A riser comprising a body of evaporative foam material with a cavity on top of the body and an exothermic mixture in the cavity and further comprising a heat shield attached to the bottom of the body to prevent premature evaporation of the evaporative foam material.

11. The riser of claim 10, further comprising a breaker core attached to the bottom of the body.

12. A riser comprising a body of evaporative foam material with a cavity on top of the body and an exothermic mixture in the cavity and further comprising a breaker core attached to the bottom of the body.

* * * * *